US008453894B2

(12) United States Patent
Jung et al.

(10) Patent No.: US 8,453,894 B2
(45) Date of Patent: Jun. 4, 2013

(54) CARRIER FOR USE WITH BOTH YOUNGER AND OLDER INFANTS

(75) Inventors: In-Soo Jung, Yongin-si (KR); In Youl Lee, Uijeongbu-si (KR)

(73) Assignee: Dong-In Entech Co., Ltd (KR)

( * ) Notice: Subject to any disclaimer, the term of this patent is extended or adjusted under 35 U.S.C. 154(b) by 0 days.

(21) Appl. No.: 13/478,688

(22) Filed: May 23, 2012

(65) Prior Publication Data

US 2012/0298702 A1 Nov. 29, 2012

(30) Foreign Application Priority Data

May 25, 2011 (KR) ..... 10-2011-0049482

(51) Int. Cl.
*A47D 13/02* (2006.01)

(52) U.S. Cl.
USPC ..... 224/160; 224/159; 224/631; 224/632

(58) Field of Classification Search
USPC ..... 224/158–161, 581, 582, 604, 627, 224/631, 632, 634, 263
See application file for complete search history.

(56) References Cited

U.S. PATENT DOCUMENTS

| | | | | |
|---|---|---|---|---|
| 4,037,764 | A * | 7/1977 | Almosnino et al. | 224/160 |
| 4,402,440 | A * | 9/1983 | Purtzer et al. | 224/160 |
| 5,704,530 | A * | 1/1998 | Scherer | 224/632 |
| 2007/0029356 | A1* | 2/2007 | Moriguchi et al. | 224/160 |
| 2010/0065594 | A1* | 3/2010 | Liljedahl et al. | 224/160 |
| 2010/0147910 | A1* | 6/2010 | Schachtner | 224/160 |

FOREIGN PATENT DOCUMENTS

| | | |
|---|---|---|
| KR | 10-2005-0033932 | 4/2005 |
| KR | 10-0501498 | 7/2005 |
| KR | 10-2010-0017379 | 2/2010 |
| KR | 20-2011-0001726 | 2/2011 |

OTHER PUBLICATIONS

Office Action, issued by the Korean Intellectual Property Office dated Aug. 9, 2011 for Korean Application No. 10-2011-0049482, 10 pages with English translation.

* cited by examiner

*Primary Examiner* — Nathan J Newhouse
*Assistant Examiner* — Corey Skurdal

(57) ABSTRACT

A carrier for use with both younger and older infants, is capable of placing the legs of younger infants having a smaller build and older infants having a bigger build into a desired M-shaped leg posture. A means for opening and closing the leg space formed in a back support web body of the carrier, adapts the carrier for continued use as the younger infants grow into older infants.

9 Claims, 16 Drawing Sheets

CARRIER FOR USE WITH BOTH YOUNGER AND OLDER INFANTS

CROSS-REFERENCE TO RELATED APPLICATION

This application claims the benefit of Korean Application No. 10-2011-0049482, filed on May 25, 2011, with the Korean Intellectual Property Office, the disclosure of which is incorporated herein by reference.

BACKGROUND OF THE INVENTION

1. Field of the Invention

The present invention relates to a carrier for use with both younger and older infants. The carrier can be used by younger infants having a smaller build and older infants having a bigger build.

2. Description of Related Art

A baby, a younger infant, and even older infants were typically moved around in a baby wrapper carried on a parent's back. In recent years, a baby carrier to allow a parent to carry his baby on his back or shoulder has come into wide use.

However, such baby carrier has the disadvantage of exposure to sunlight. The baby carriers that use a sunlight screen present additional problems of screens that cannot be optionally mounted on the baby carrier. These disadvantages may be avoided by a baby carrier disclosed in Korean Patent No. 10-0763412 owned by the present applicant. However, the techniques disclosed in Korean Patent No. 10-0763412 do not overcome the following problems.

An M-shaped leg posture is the recommended leg posture of a baby in a baby carrier. As used herein, the phrase "M-shaped leg posture" refers to a posture where a baby's knee is located above its hip. This leg posture allows a baby's hip to be tilted toward the front slightly arching its back, to minimize pressure from above, thereby reducing the risk of backbone damage.

For the purpose of achieving this posture, a user (for example, a baby's parent) has to purchase and use different size baby carriers based on age of the baby in days.

For example, a small-built younger infant, up to 100 days old (particularly as old as from 30 days to 100 days) should be placed in the M-shaped leg posture in a baby carrier. As shown in FIG. 1, a younger infant in an M-shaped leg position leaves spaces 31 on both sides of the lower part of a back support web body 30. Shoulder supports 10 are lockstitched to both sides of the upper part of the back support with body 30. A waist band 20 for fastening to a user's waist is lockstitched to the lower part of the back support web body 30.

With this configuration, the legs of the younger infant in the carrier are placed in the M-shaped leg posture only when the lower part of the back support web body 30 supports the hip of the small-built younger infant.

Since the legs of the younger infant placed in the M-shaped leg posture are placed in spaces 31 formed in both sides of the lower part of the back support web body 30, it is possible for the user to move with the younger infant in the baby carrier.

A bigger older infant, older than 100 days, should also be in an M-shaped leg posture in the baby carrier. However, when such a big-built older infant is put into the baby carrier having the same back support web body 30 sized for a younger infant, injury to the baby may occur. Since the lower part of the back support web body 30 is narrower than the hip of the older infant and the legs of the older infant stand up, there is a risk of backbone damage, or dislocation of a hip joint, and so on.

In order to avoid this problem, as shown in FIG. 2, the M-shaped leg leading spaces are removed from the back support web body 40. The shoulder supports 10 are lockstitched to both sides of the upper part of the back support web body 40. The waist band 20 for fastening to the user's waist is lockstitched to the lower part of the back support web body 40. The hips and some of the thigh of the big-built older infant can then be supported in the M-shaped leg posture.

The problem remains that the user has to buy at least two different baby carriers, one for use with a younger infant, and one for use with the older infant, as the small-built younger infant grows.

SUMMARY OF THE INVENTION

It is an object of the present invention to provide a carrier that can be used with both younger and older infants, maintaining an M-shaped leg posture for the different sized infants.

According to an aspect of the invention, there is provided a carrier for use with both younger and older infants, including a back support web body which supports the back of a baby and has an M-shaped leg leading space formed in each side of the lower part thereof. A waist band is attached to the bottom of the back support web body for fastening to a user's waist. A space opening/closing member which opens or closes the M-shaped leg leading space, is formed in each side of the lower part of the back support web body.

The space opening/closing member includes a hip supporting part, made of flexible material, with its upper and lower centers fixed to the outer side of the back support web body and the waist band. A pair of movable rails are respectively fixed to the back support web body and the waist band to which both sides of the hip supporting part are respectively fixed. A pair of horizontal moving connectors which are respectively fixed to the upper and lower parts of the hip supporting part, are slidably movable to allow the hip supporting part to be folded. The connectors have connecting projections forming a horizontal moving space, with a lead-in groove.

Preferably, the carrier further includes a binding member which fixes the hip supporting part in a position where the hip supporting part is unfolded or doubly folded to open or close the M-shaped leg leading space formed in both sides of the lower part of the back supporting body.

Preferably, the carrier further includes a space maintenance binding member which fixes the hip supporting part at a position where the edges of both sides of the hip supporting part are doubly folded to open the M-shaped leg leading space formed in both sides of the lower part of the back supporting body.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein.

DETAILED DESCRIPTION OF THE PREFERRED EMBODIMENTS

In the following description, a baby placed in a carrier usable with both younger and older infants, according to the present invention, are generally divided into a small-built younger infant being about 30 days to 100 days old, and a big-built older infant over 100 days.

Figure 1:
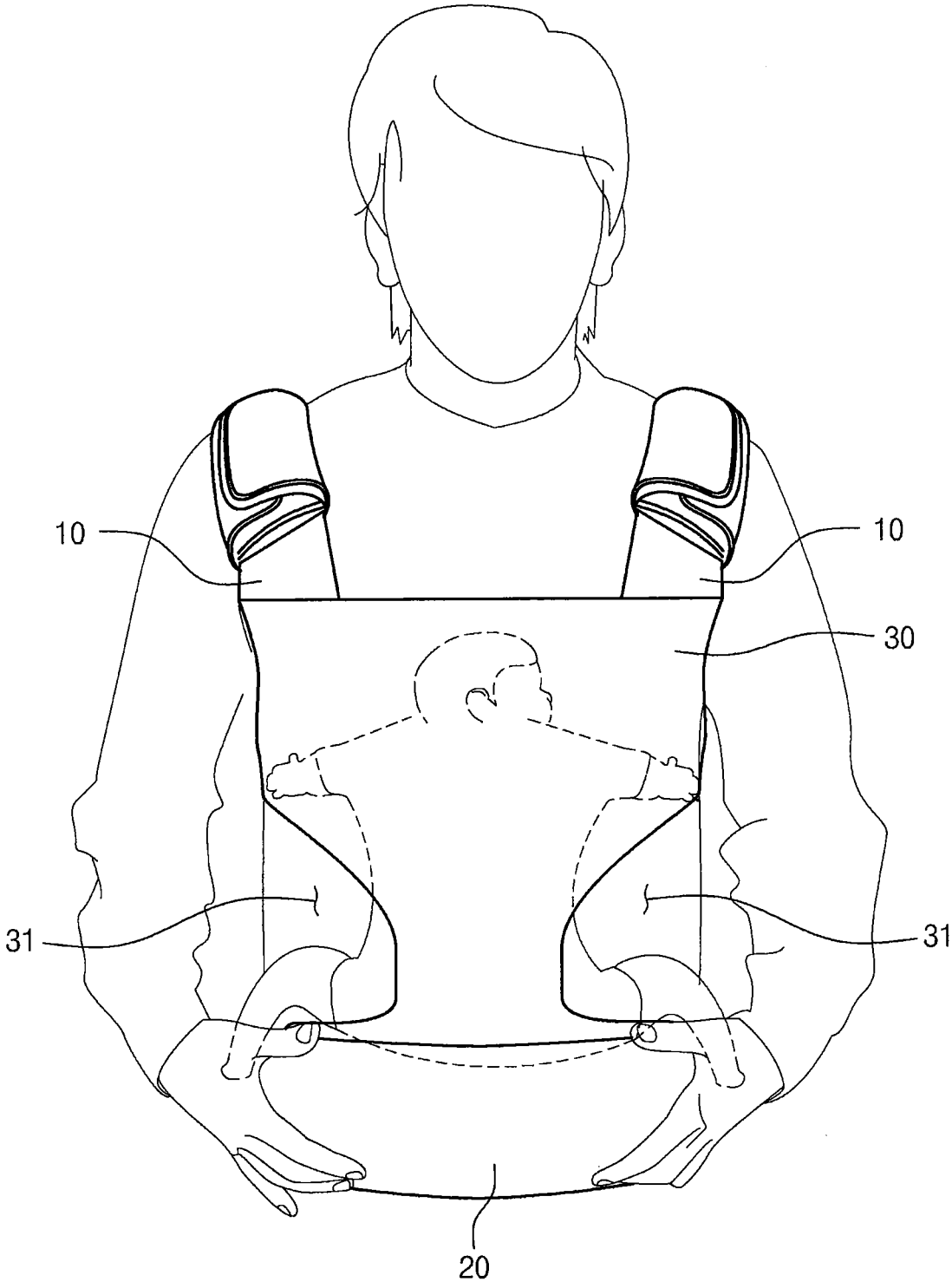
FIG. 1 is a view showing a conventional younger infant carrier used for younger infants from birth till 100 days or so.
Figure 2:
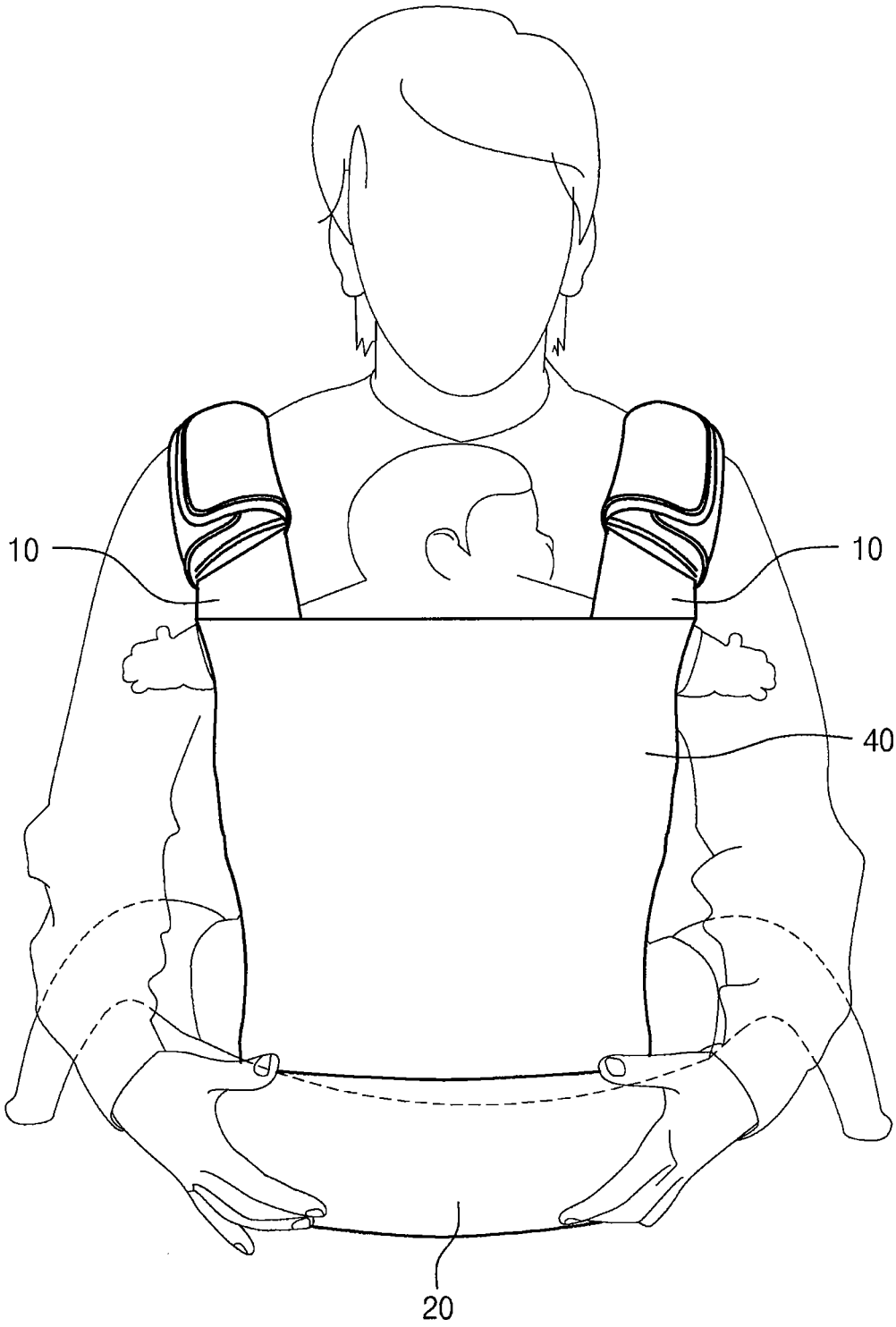
FIG. 2 is a view showing a conventional older infant carrier used for older infants above 100 days.
Figure 3:
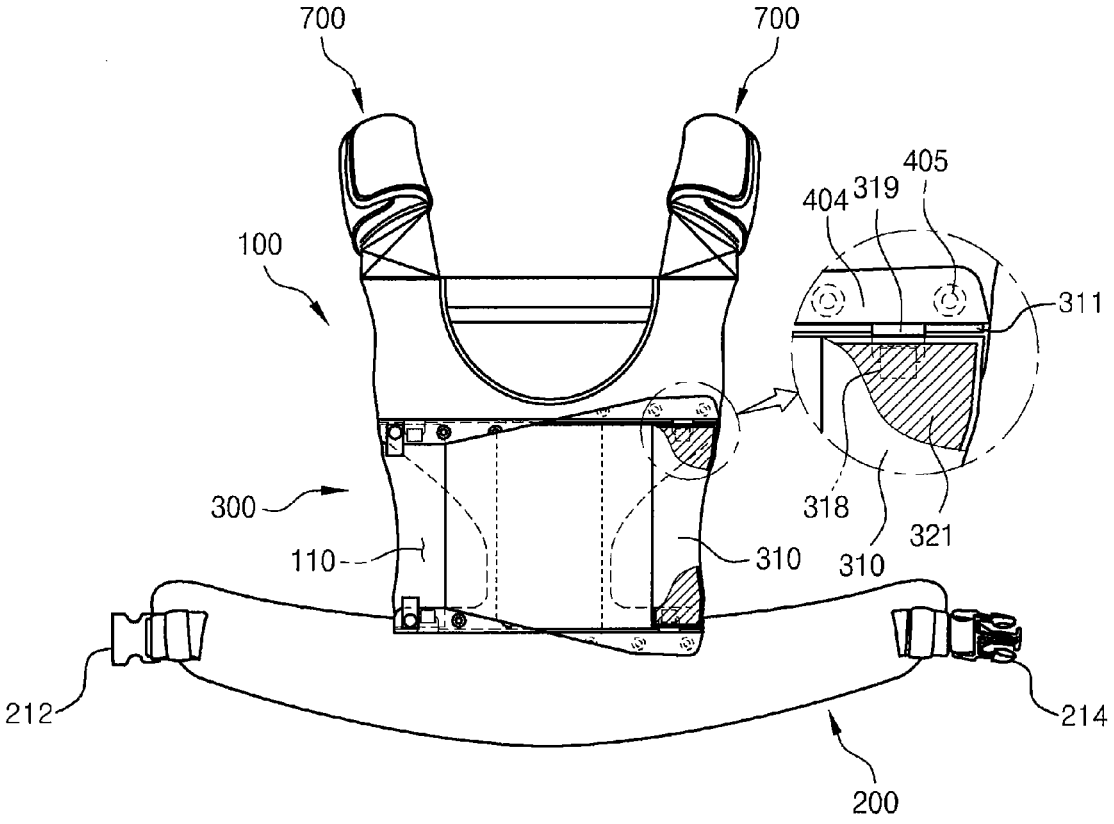
FIG. 3 is a view showing a carrier used for both of younger and older infants according to an embodiment of the present invention.
Figure 4:
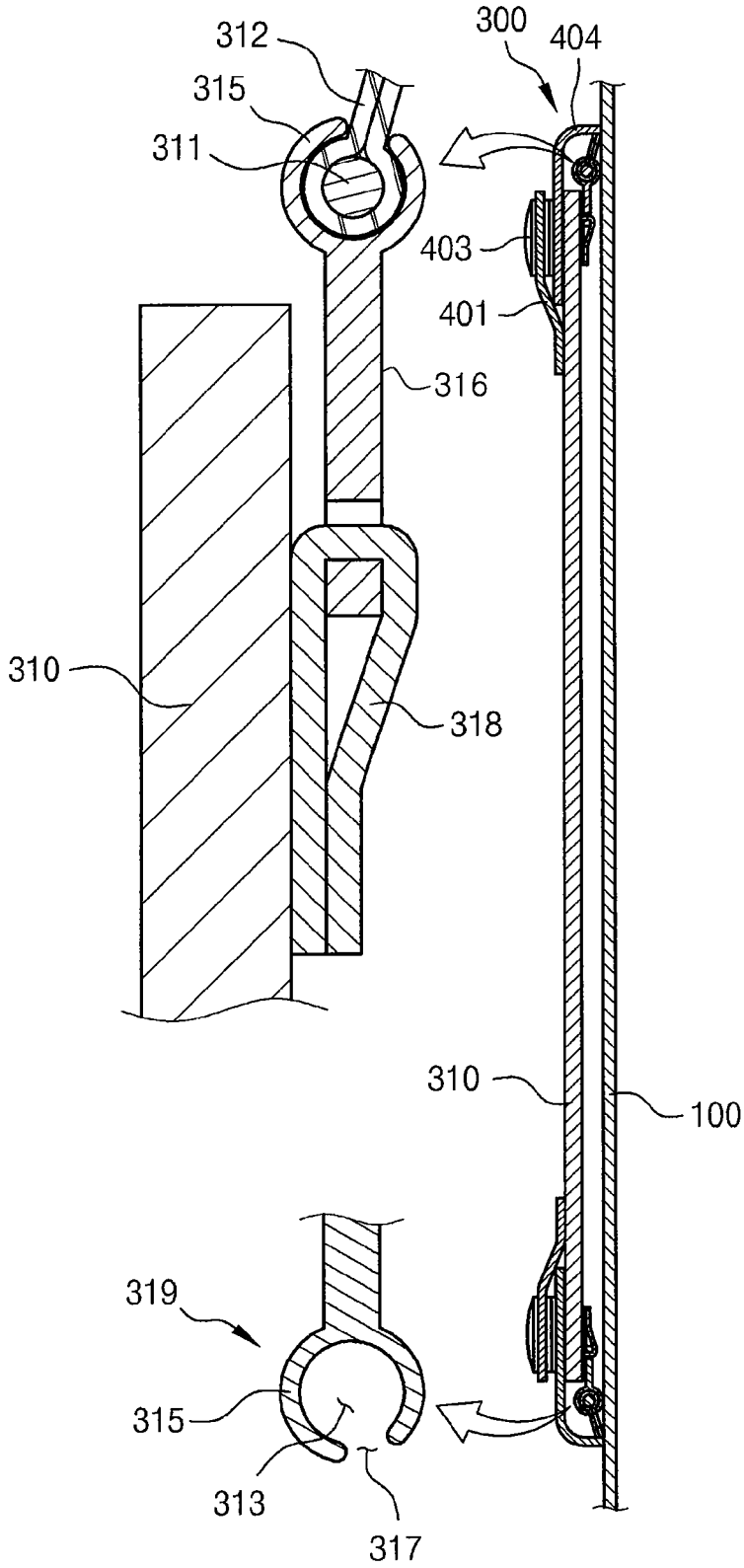
FIG. 4 is a longitudinal sectional view of a back support web body of the carrier according to the embodiment.
Figure 5:
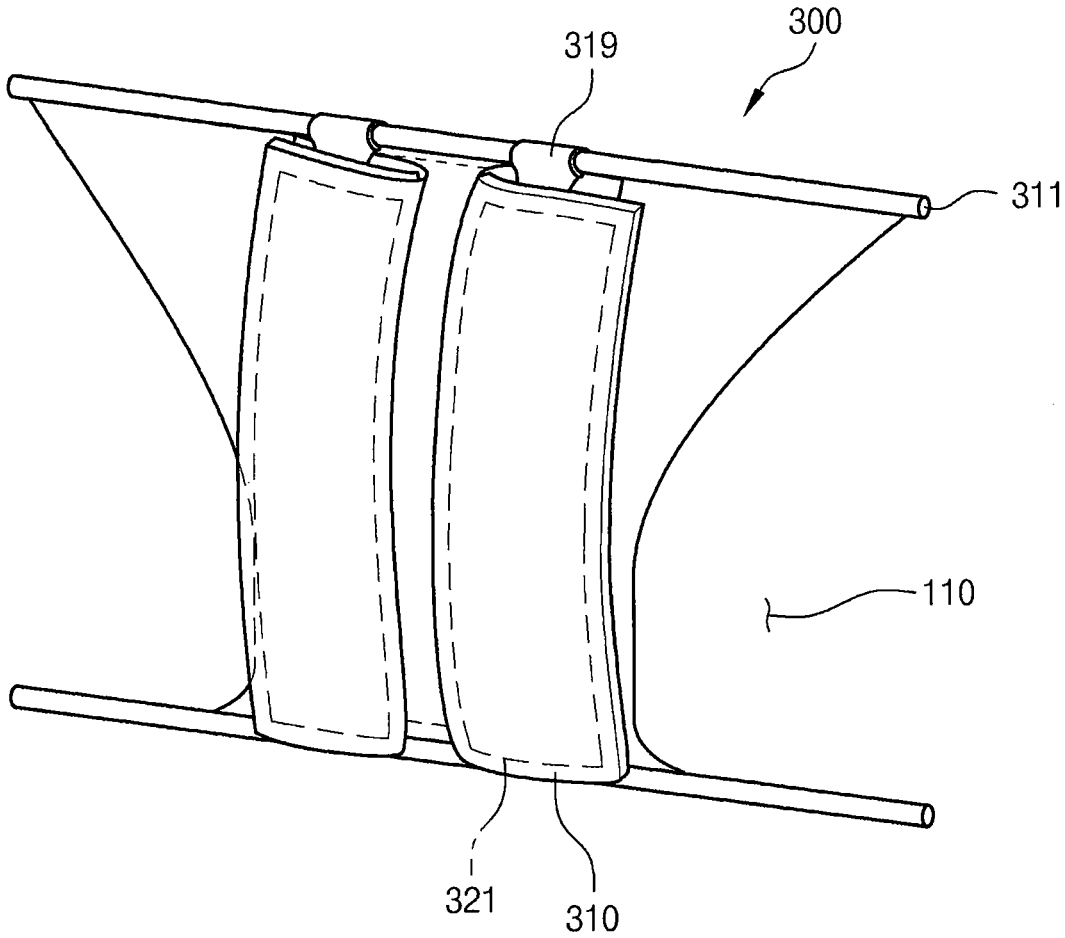
FIG. 5 is a perspective view showing an open position of an M-shaped leg space formed in the back support web body of FIG. 4.
Figure 6:
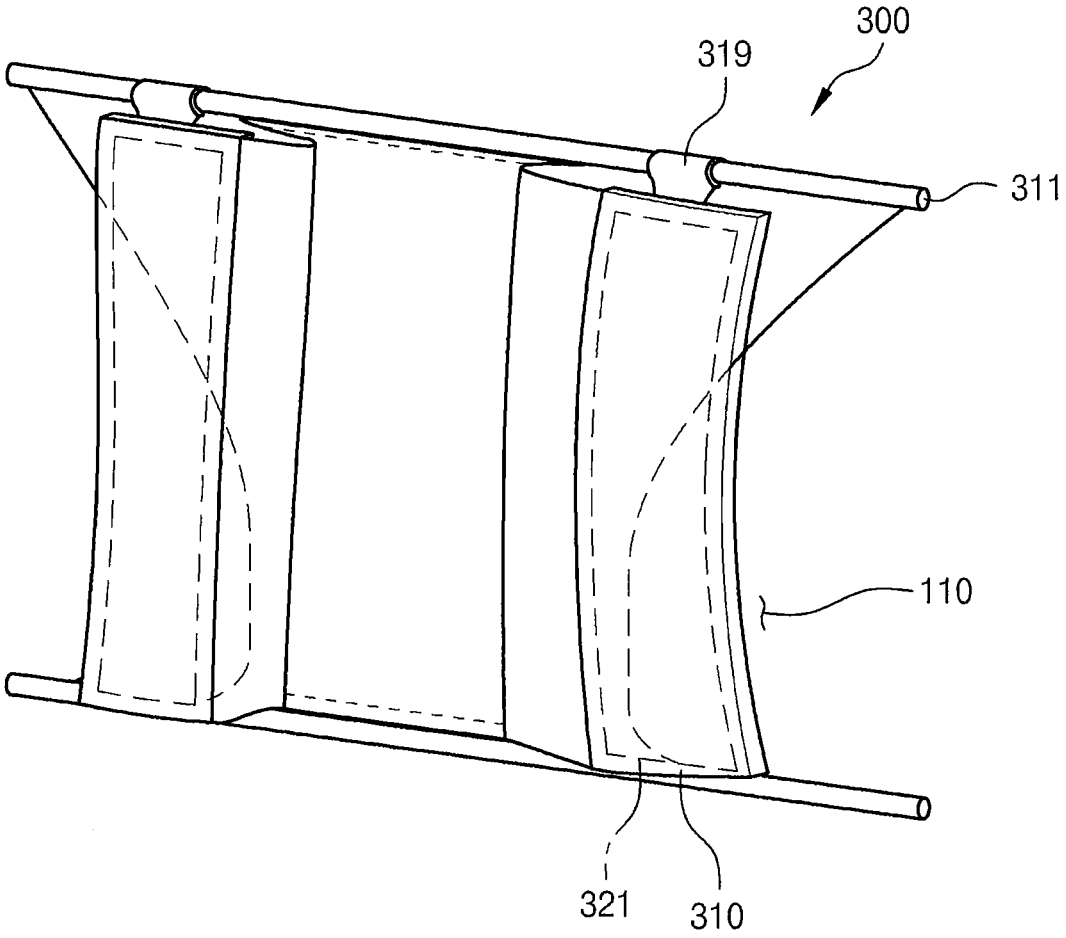
FIG. 6 is a perspective view showing a closing position of an M-shaped leg space formed in the back support web body of FIG. 4.
Figure 7:
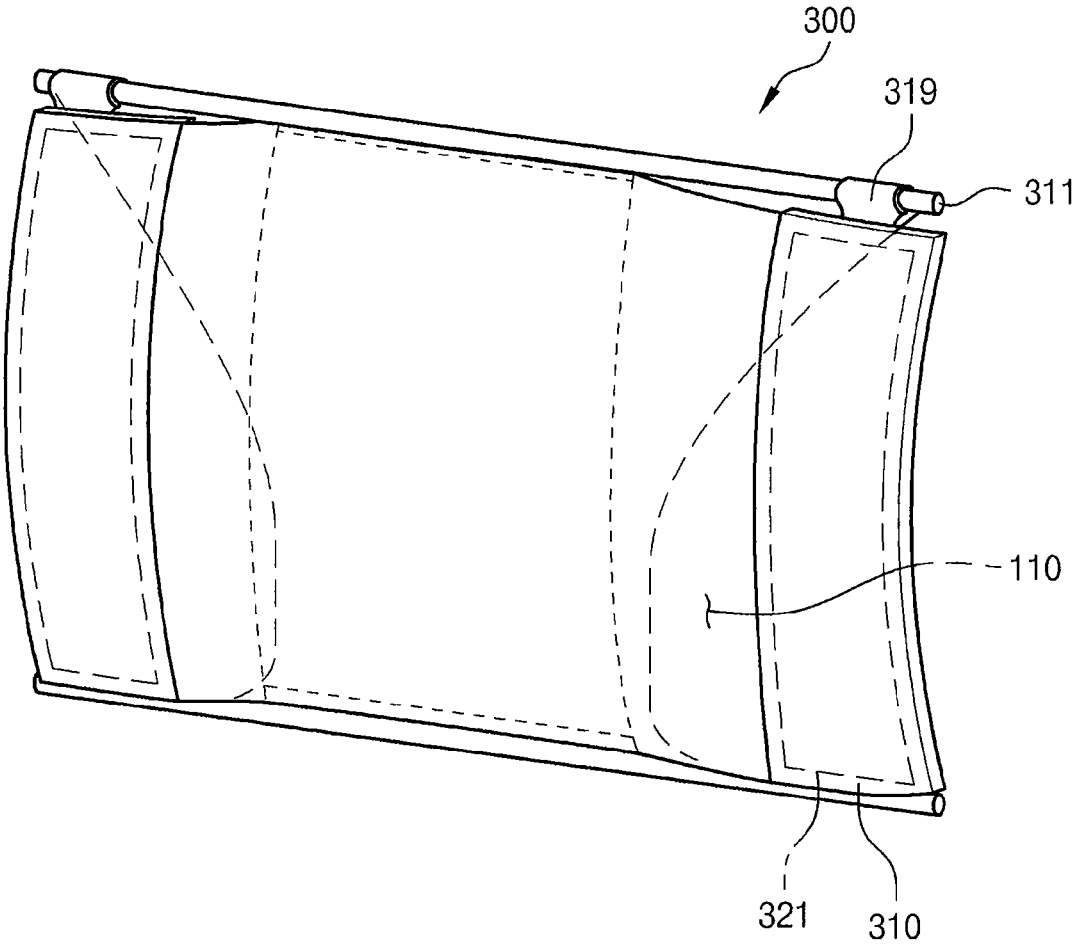
FIG. 7 is a perspective view showing a closed position of an M-shaped leg space formed in the back support web of FIG. 4.
Figure 8:
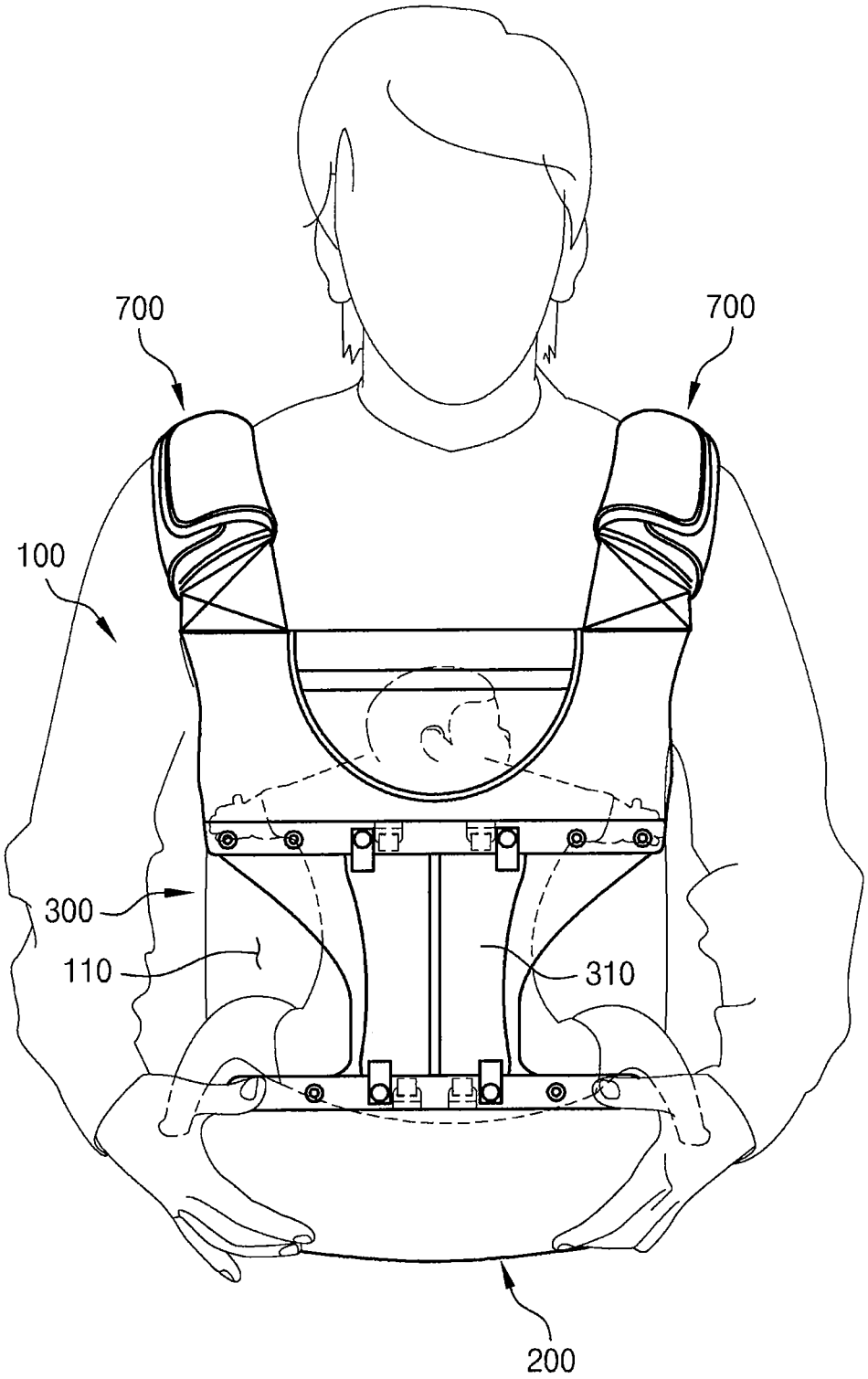
FIG. 8 is a view showing the younger infant M-shaped leg space formed in the back support web body opened to allow a younger infant having a small build to take an M-shaped leg posture.
Figure 9:
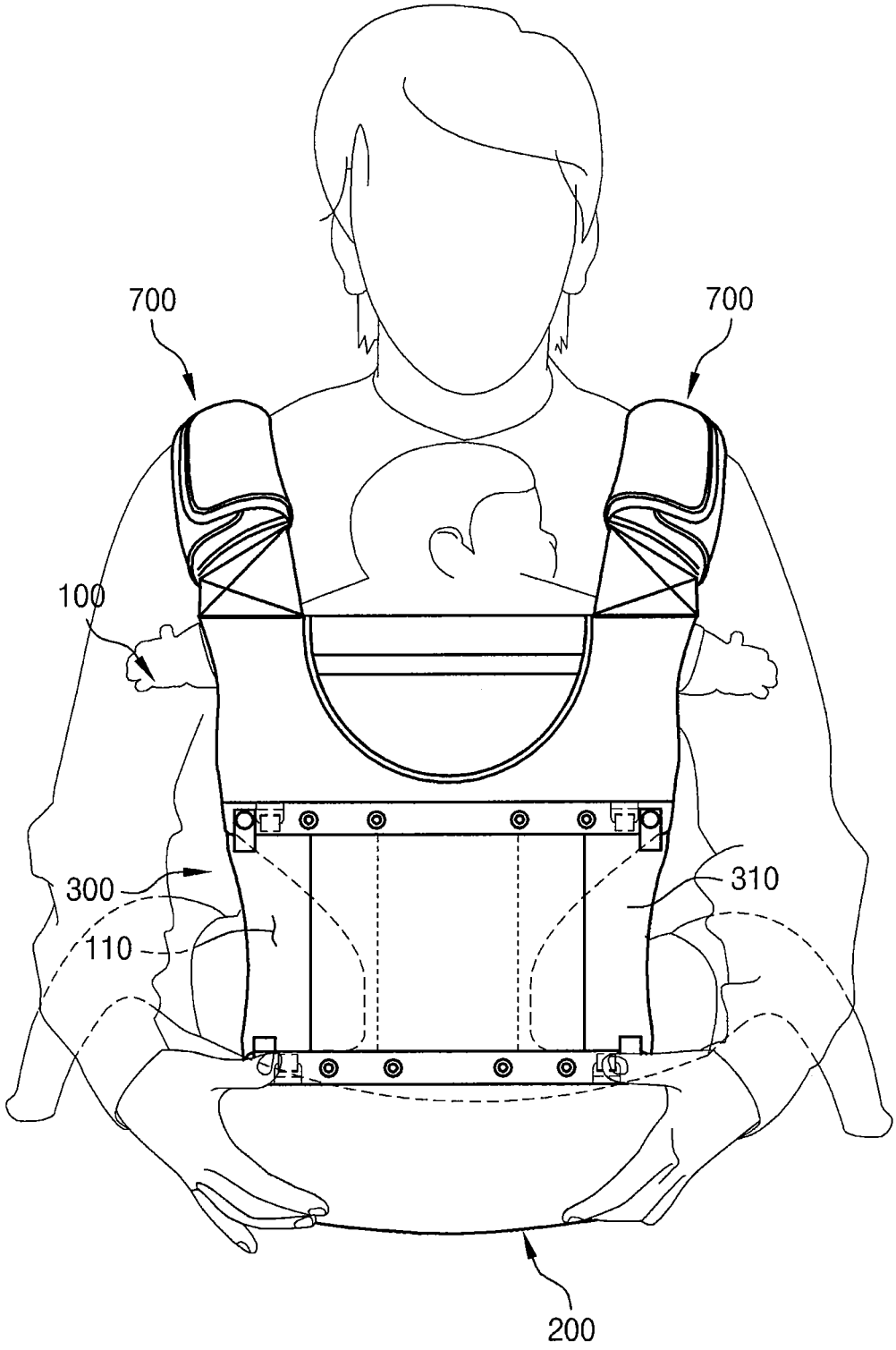
FIG. 9 is a view showing the younger infant M-shaped leg space formed in the back support web body closed to allow an older infant having a big build to take an M-shaped leg posture.
Figure 10:
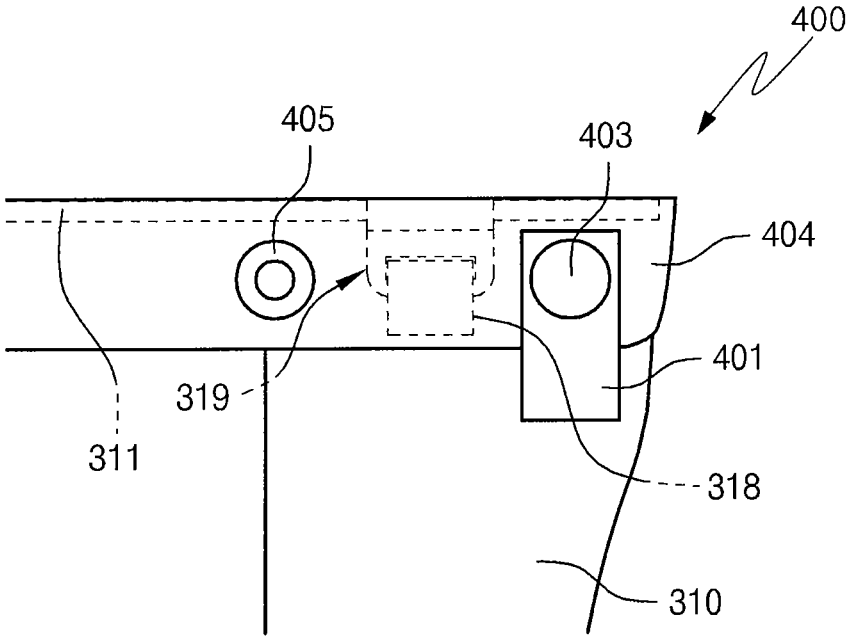
FIG. 10 is a view showing main parts of a binding member provided in the back support web body.
Figure 11:
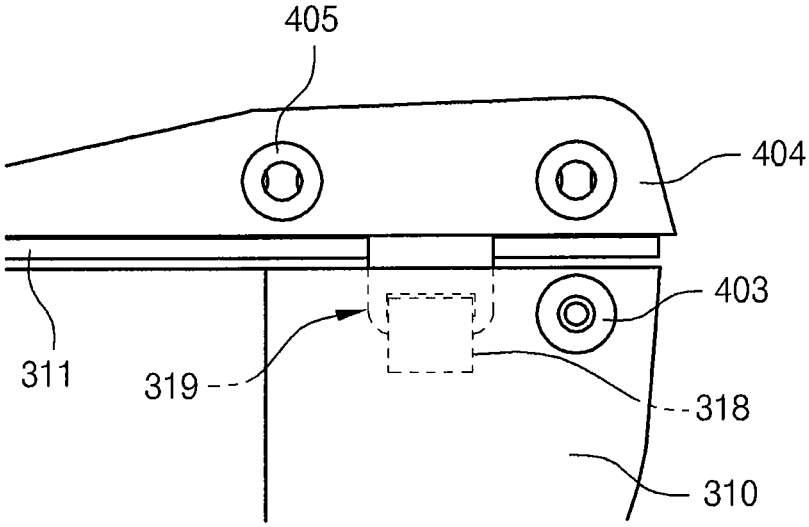
FIG. 11 is a view showing main parts of a binding member provided in the back support web body.
Figure 12:
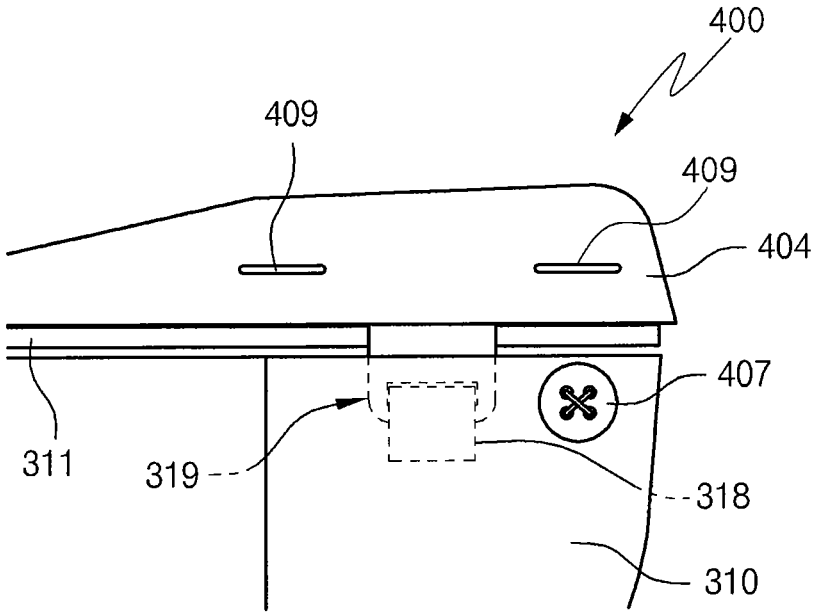
FIG. 12 is a view showing main parts of a binding member provided in the back support web body.
Figure 13:
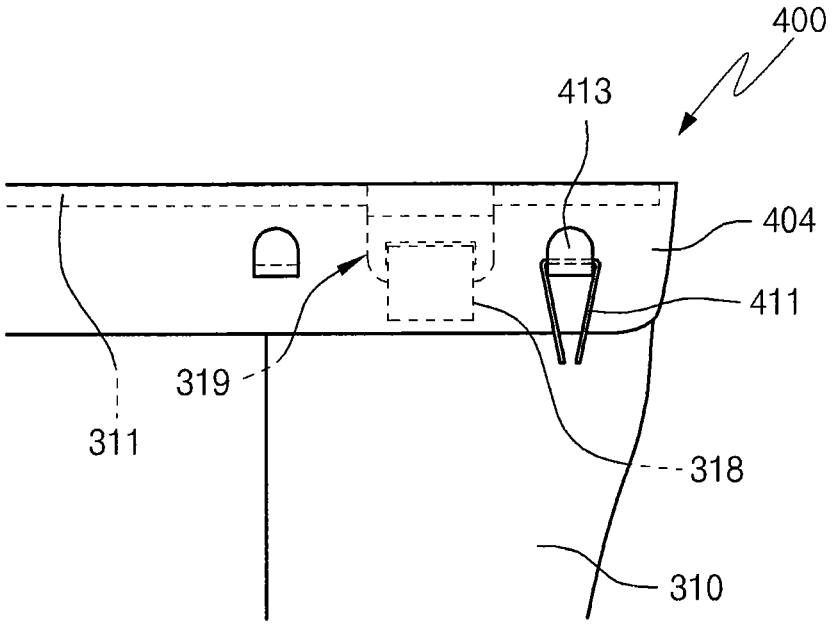
FIG. 13 is a view showing main parts of a binding member provided in the back support web body.
Figure 14:
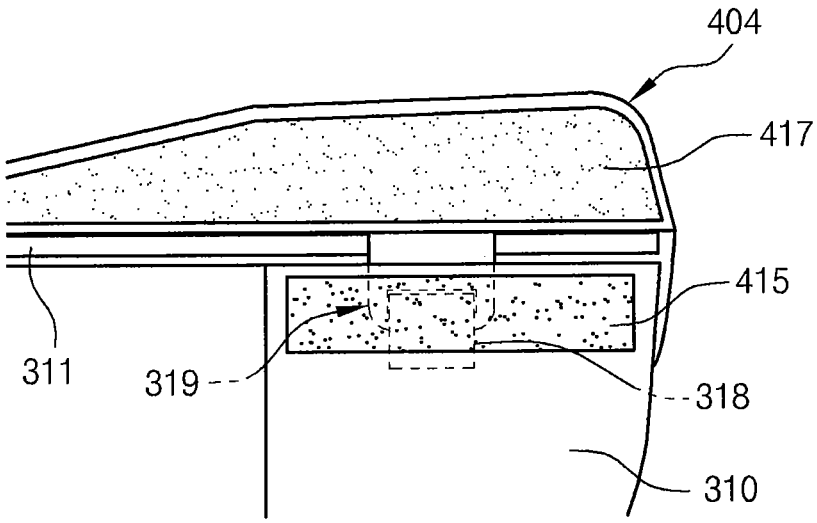
FIG. 14 is a view showing main parts of a binding member provided in the back support web body.
Figure 15:
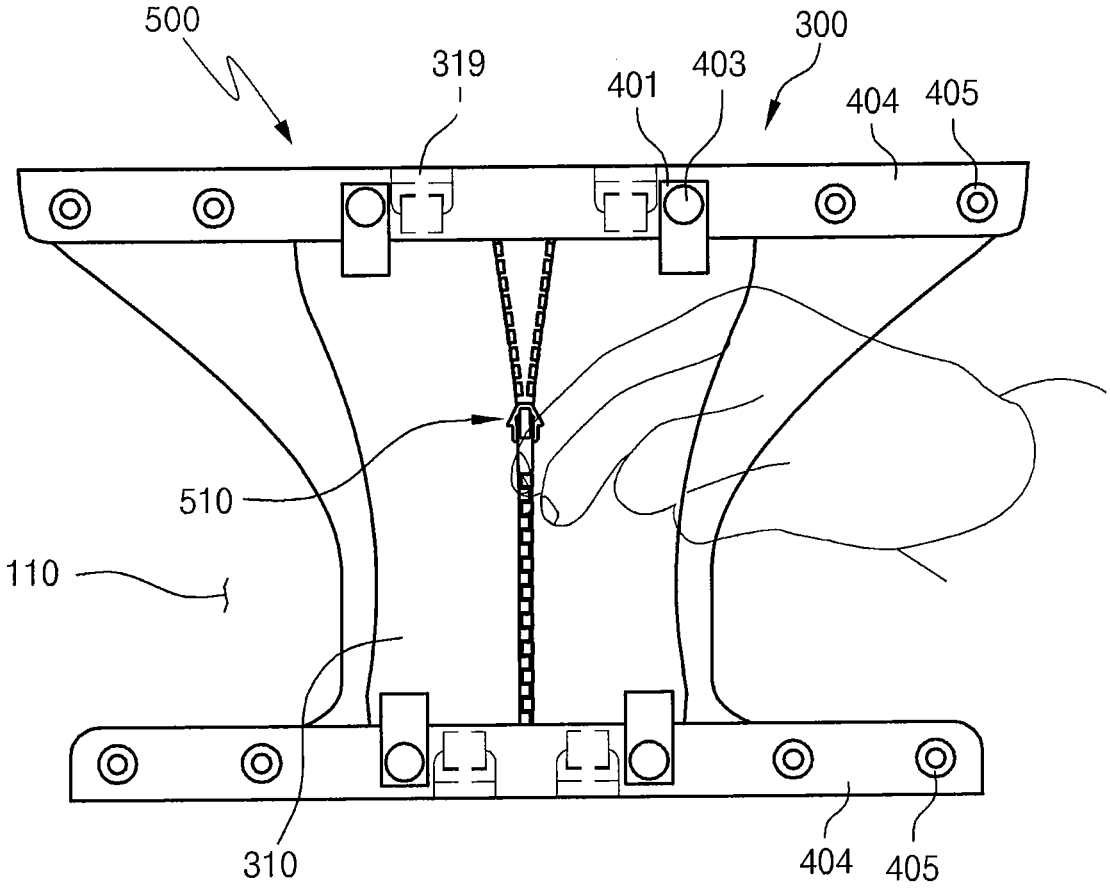
FIG. 15 is a view showing main parts of a space maintenance binding member provided in the back support web body.
Figure 16:
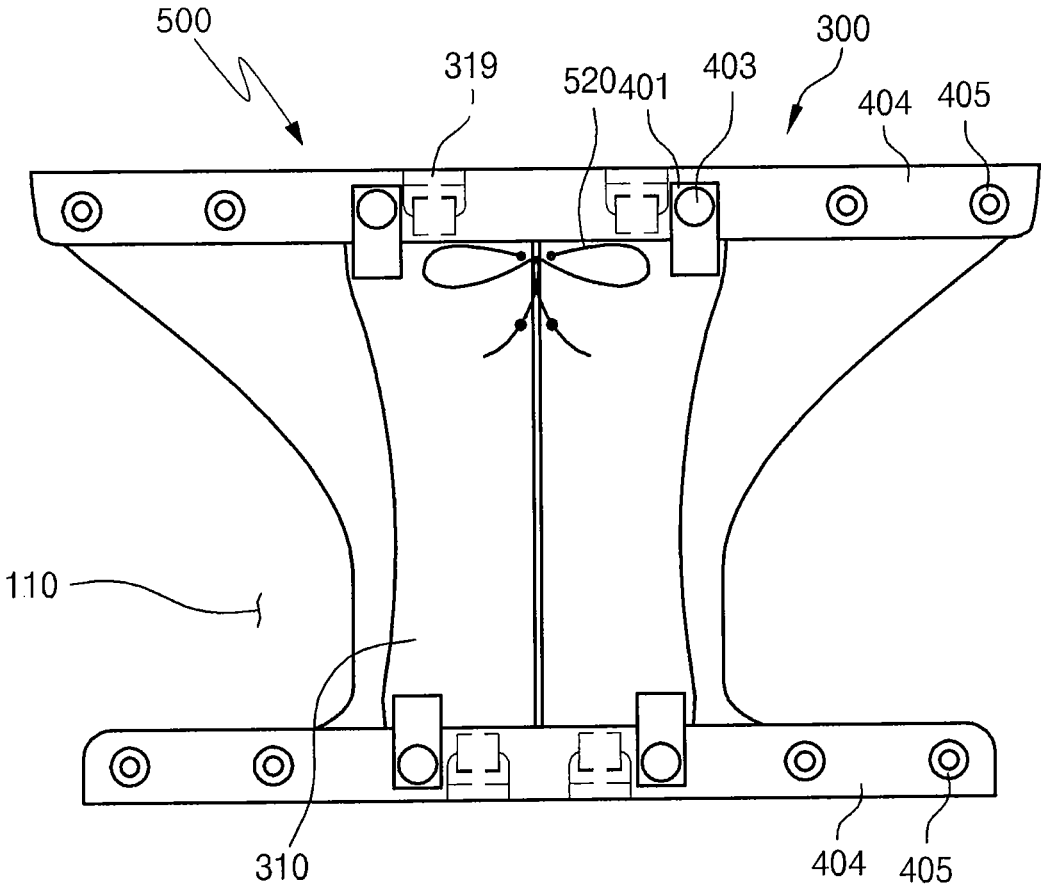
FIG. 16 is a view showing main parts of a space maintenance binding member provided in the back support web body.

FIG. 3 shows a carrier usable for both younger and older infants, according to an embodiment of the present invention. FIG. 4 is a cross-section of a back support web body 310 of a carrier according to the embodiment. FIGS. 5 to 7 show phased closing of an M-shaped leg leading space formed in the back support web body of FIGS. 3 and 4. FIG. 8 shows the carrier in use, with a younger infant. The M-shaped leg space 110 formed in the back support web body 310 opened to allow a younger infant having a small build to take an M-shaped leg posture. FIG. 9 shows the carrier in use with the younger infant M-shaped leg space 110 formed in the back support web body 310 closed to allow an older infant having a big build to take an M-shaped leg posture. FIG. 10 shows main parts of a binding member provided in the back support web body according to a first example. FIG. 11 shows main parts of a binding member provided in the back support web body according to another example. FIG. 12 shows main parts of a binding member provided in the back support web body according to another example. FIG. 13 shows main parts of a binding member provided in the back support web body according to yet another example. FIG. 14 shows main parts of a binding member provided in the back support web body according to another example. FIG. 15 shows main parts of a space maintenance binding member provided in the back support web body according to another example. FIG. 16 shows main parts of a space maintenance binding member provided in the back support web body according to another example.

As shown in FIG. 3, a younger/older infant carrier according to the present invention generally includes a back support web body 100, a waist band 200, a space opening/closing member 300 and a pair of shoulder supports 700.

The back support web body 100 serves to support the back of a baby. For a younger infant, M-shaped leg space 110 is formed in each side of the lower part thereof in such a manner that a small-built younger infant can take an M-shaped leg posture when the infant is put in the carrier.

The waist band 200 for fastening around a user's waist, is attached to the bottom of the back support web body 100 so that the baby can be supported by the back support web body 100. A female buckle 212 and a male buckle 214 are connected to the ends of the waist band 200, respectively, so that the waist band 200 can be fastened around a user's waist.

The pair of shoulder supports 700 each have one end connected to one end of the back supporting body 100 and the other end connected to the other end of the back support web body 100, so that the user can move with the baby put in the carrier.

The space opening/closing member 300 serves to open/close the M-shaped leg space 110, which is formed in each side of the lower part of the back support web body 100, in phases. Since the M-shaped leg space 110 can be optionally opened or closed in phases with growth of the small-built younger infant into a big-built older infant, this space opening/closing member 300 allows both the younger and older infant to be placed into an M-shaped leg posture in the same carrier.

Such a space opening/closing member 300 includes a hip supporting part 310 which is made of flexible material and has its upper and lower centers fixed to the outer side of the back support web body 100 and the waist band 200, respectively. A pair of movable rails 311 are respectively fixed to the back support web body 100 and the waist band 200 to which both sides of the hip supporting part 310 are respectively fixed. A pair of horizontal moving connectors 319 which are respectively fixed to the upper and lower parts of the hip support web part 310, are slidably movable to allow the hip support web part 310 to be folded. The moving connectors have connecting projections 315 (FIG. 4) to enclose a space 313. A partial opening is formed in projections 315 by a lead-in groove 317.

The hip support web part 310 is preferably made of cotton material. A shape retention pad 321 may be overlaid and lockstitched near both edges of the hip supporting part 310 so that the hip supporting part 310 made of the cotton material will not lose its shape when supporting a baby.

Such a shape retention pad 321 may be a combination of memory foam having high elasticity, such as a sponge, and an inflexible foamed plastic hardboard.

In order to fix the movable rails 311 to the back support web body 100 and the waist band 200, respectively, the movable rails 311 are wrapped by a connection fabric 312 (FIG. 4). An end portion of the connection fabric 312 is lockstitched to the back support web body 100 and the waist band 200. In this case, although not shown in the figures, a connecting rod is integrated with the movable rails 311 and is lockstitched with the connection fabric 312 so that the movable rails 311 wrapped by the connection fabric 312 cannot be moved within the connection fabric 312.

The horizontal moving connectors 319 are lockstitched and fixed to the rear side of the hip supporting part 310 by a connection band 318 which is locked in a locking groove of connection pieces 316 integrally formed in the connecting projections 315 of the horizontal moving connectors 319.

A process of opening the younger infant M-shaped leg space 110 formed in both sides of the lower part of the back support web body 100 in phases using the above-configured space opening/closing member 300 for both a younger and older infant will be described with reference to FIGS. 5 to 7.

FIG. 5 shows the carrier support with the younger infant M-shaped leg leading space 110 formed in both sides of the lower part of the back support web body 100 opened by sliding the horizontal moving connectors 319 on moving rails 311 to the center of the moving rails 311. Non-lockstitched edges of both sides of the hip supporting part 310 are doubly folded, so that a small-built younger infant can take an M-shaped leg posture in the carrier.

In this case, the doubly-folded edges of both sides of the hip supporting part 310 are as wide as the shape retention pad 321, and the doubly-folded edges of both sides of the hip supporting part 310 are folded such that inner sides of the shape retention pad 321 near the doubly-folded edges of both sides of the hip supporting part 310 can make contact with each other.

FIG. 8 shows the carrier adjusted for a small-built younger infant, with the infant positioned in the carrier.

The horizontal moving connectors 319, fixed near an edge of the back side of the hip supporting part 310, by virtue of the weight of the small-built younger infant, pull the upper and lower moving rails 311 in a direction perpendicular to the horizontally-arranged moving rails 311 and lock the moving connectors 319 in place.

FIG. 6 shows a carrier support web where the younger infant M-shaped leg space 110 formed in both sides of the lower part of the back support web body 100 is about half opened. The horizontal moving connectors 319, fixed to the doubly-folded edges of both sides of the hip supporting part 310, are moved towards the outside of the moving rails 311. A middle-built baby between a small-built younger infant and a big-built older infant can take an M-shaped leg posture in a carrier so adjusted.

FIG. 7 shows a carrier support web where the M-shaped leg leading space 110 formed in both sides of the lower part of the back support web body 100 is closed by further sliding the horizontal moving connectors 319, to the outside of the moving rails 311. A big-built older infant can take an M-shaped leg posture in the carrier so adjusted.

FIG. 9 shows a carrier adjusted for a big-built younger infant with a baby located in the carrier.

In this embodiment, a binding member 400 (see FIGS. 10 to 14) is further provided to fix the hip supporting part 310 at a position where the edges of both sides of the hip supporting part 310 are doubly folded so that a younger or older infant can take an M-shaped leg posture in the carrier, thereby providing complete binding of the folded hip supporting part 310.

This binding member 400 may be implemented with different configurations.

The binding member 400 may have a button structure of different configurations. First, as shown in FIG. 10, the button structure of the binding member 400 includes a connection strap 401 having its one end fixed to an edge of the outer side of the hip supporting part 310. A male button 403 is fixed to the other end of the connection strap 401. A female button 405 is fixed to the back support web body 100.

The female button 405 may be fixed to a finishing fabric 404 whose one side is lockstitched along the back support web body 100 and the waist band 200. The reason for fixing the female button 405 to the finishing fabric 404 is to conceal the moving rails 311, and the horizontal moving connectors 319, and so on, thereby providing an aesthetic appearance. The female and male buttons may be positioned in consideration of a user's taste and convenience.

As shown in FIG. 11, the button structure of the binding member 400 may be a simplified structure where the male button 403 is directly fixed to the hip supporting part 310 without being fixed to the connection strap 401.

As shown in FIG. 12, the binding member 400 may include a connection strap 401 having its one end fixed to an edge of the outer side of the hip supporting part 310. A stud 407 is fixed to the other end of the connection strap 401, and a stud hole 409 is formed in the back support web body 100. The waist band 200 (not shown) fixed with both sides of the hip supporting part 310 is disposed to correspond to a position where the hip supporting part 310 is unfolded or doubly folded.

The stud hole 409 is preferably formed in a finishing fabric 404 whose one side is lockstitched along the back support web body 100 and the waist band 200.

As shown in FIG. 13, the binding member 400 may include a fixing loop 411 fixed to an edge of the outer side of the hip supporting part 310, and a hook 413 which is fixed to the back support web body 100.

The waist band 200 is fixed to both sides of the hip supporting part 310 and is disposed to correspond to a position where the hip supporting part 310 is unfolded or doubly folded.

Here, the fixing loop 411 is preferably made of elastic material and tightly fixed to the hook 413 by virtue of its elasticity.

As shown in FIG. 13, the hook 413 may be an L shape or a stud shape, and is preferably formed in a finishing fabric 404 whose one side is lockstitched along the back support web body 100 and the waist band 200.

As shown in FIG. 14, the binding member 400 may include a male Velcro tape 415 provided on an edge of the outer side of the hip support part 310, and a female Velcro tape 417 fixed to the back support web body 100. The waist band 200 is fixed to both sides of the hip supporting part 310 and is disposed to correspond to a position where the hip supporting part 310 is unfolded or doubly folded.

The female Velcro tape 417 is preferably attached to a finishing fabric 404 whose one side is lockstitched along the back support web body 100 and the waist band 200.

In a different embodiment, a space maintenance binding member 500 (see FIGS. 15 and 16) may be further provided to fix the hip supporting part 310 at a position where the edges of both sides of the hip supporting part 310 are doubly folded to contact each other so that a small-built younger infant can take an M-shaped leg posture in the carrier.

This space maintenance binding member 500 may be implemented in different configurations.

As shown in FIG. 15, the space maintenance binding member 500 may include a zipper 510 lockstitched along both sides of a contact portion when the hip supporting part 310 is folded.

As shown in FIG. 16, the space maintenance binding member 500 may include a pair of binding strings 520 which are respectively provided in both sides of a contact portion when the hip supporting part 310 is folded. Here, a pair of upper binding strings 520 and a pair of lower binding strings may be provided to further increase binding efficiency.

While the present invention has been particularly shown and described with reference to exemplary embodiments thereof, it will be understood by those skilled in the art that various changes in form and detail may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. A carrier for use with both younger and older infants, comprising:

a back support web body (100) for supporting the back of a baby having a leg space (110) formed in each side;

a waist band (200) attached to the bottom of the back support web body (100) for fastening to a user's waist; and a space opening/closing member (300) for opening or closing the leg space (110), in phases, the space opening/closing member (300) including:

a hip supporting part (310) of flexible material having its upper and lower centers fixed to the outer side of the back support web body (100) and the waist band (200), respectively;

a pair of movable rails (311) respectively fixed to the back support web body (100) and the waist band (200); and a plurality of horizontal moving connectors (319) fixed to the upper and lower parts of the hip supporting part (310), slidably movable along the movable rails to allow the hip supporting part (310) to be folded.

2. The carrier according to claim 1, further comprising a binding member (400) which fixes the hip supporting part (310) at a preselected position allowing the hip supporting part (310) to be unfolded or doubly folded to open or close the leg space (110) formed in both sides of the lower part of the back support web body (100).

3. The carrier according to claim 2, wherein the binding member 400 includes:

a connection strap (401) having its one end fixed to an edge of the outer side of the hip supporting part (310);

a stud (407) fixed to the other end of the connection strap (401); and the back support web body (100) and the waist band (200) having a stud hole.

4. The carrier according to claim 2, further comprising a shape retention pad (321) overlaid and fixed near both edges of the hip supporting part (310).

5. The carrier according to claim 3, further comprising a shape retention pad (321) overlaid and fixed near both edges of the hip supporting part (310).

6. The carrier according to claim 2, further comprising a space maintenance binding member (500) for fixing the hip supporting part (310) at a position where the edges of both sides of the hip supporting part (310) are doubly folded to contact each other.

7. The carrier according to claim 3, further comprising a space maintenance binding member (500) for fixing the hip supporting part (310) at a position where the edges of both sides of the hip supporting part (310) are doubly folded to contact each other.

8. The carrier according to claim 6, wherein the space maintenance binding member (500) includes a zipper (510) along a contact portion of the hip supporting part (305) when the hip supporting part (310) is folded.

9. The carrier according to claim 7, wherein the space maintenance binding member (500) includes a zipper (510) along a contact portion of the hip supporting part (305) when the hip supporting part (310) is folded.

* * * * *